US007513486B2

(12) United States Patent
Bachert

(10) Patent No.: US 7,513,486 B2
(45) Date of Patent: Apr. 7, 2009

(54) HUMIDIFIER WITH IMPROVED UV DISINFECTION

(75) Inventor: Karl Bachert, Roslyn, NY (US)

(73) Assignee: KAZ, Inc., Southborough, MA (US)

( * ) Notice: Subject to any disclaimer, the term of this patent is extended or adjusted under 35 U.S.C. 154(b) by 0 days.

(21) Appl. No.: 11/066,104

(22) Filed: Feb. 25, 2005

(65) Prior Publication Data

US 2005/0258554 A1 Nov. 24, 2005

Related U.S. Application Data

(60) Provisional application No. 60/573,982, filed on May 24, 2004, provisional application No. 60/576,776, filed on Jun. 2, 2004.

(51) Int. Cl.
*B01F 3/04* (2006.01)

(52) U.S. Cl. ..... 261/3; 261/36.1; 261/107; 261/DIG. 46; 250/436; 250/437

(58) Field of Classification Search ..... 261/3, 261/36.1, 37, 106, 107, DIG. 46, DIG. 65; 210/748, 764; 422/24, 186.3; 250/436, 437
See application file for complete search history.

(56) References Cited

U.S. PATENT DOCUMENTS

| | | | | | |
|---|---|---|---|---|---|
| 3,434,850 | A * | 3/1969 | Huff | 426/240 |
| 3,511,162 | A * | 5/1970 | Truhan | 454/187 |
| 4,630,475 | A * | 12/1986 | Mizoguchi | 73/293 |
| 4,676,896 | A * | 6/1987 | Norton | 210/192 |
| 5,217,607 | A * | 6/1993 | Dalton et al. | 210/143 |
| 5,589,132 | A * | 12/1996 | Zippel | 422/24 |
| 5,675,153 | A * | 10/1997 | Snowball | 250/438 |
| 5,783,117 | A * | 7/1998 | Byassee et al. | 261/29 |
| 5,859,952 | A * | 1/1999 | Levine et al. | 392/405 |
| 6,547,963 | B1 * | 4/2003 | Tsai | 210/232 |
| 7,073,781 | B2 * | 7/2006 | Mulvaney | 261/37 |
| 2003/0205454 | A1 * | 11/2003 | Hlavinka et al. | 204/157.15 |
| 2004/0004044 | A1 * | 1/2004 | Anderson | 210/748 |
| 2004/0005260 | A1 * | 1/2004 | Mulvaney | 422/305 |

FOREIGN PATENT DOCUMENTS

| | | |
|---|---|---|
| CN | 1392374 | 1/2003 |

* cited by examiner

*Primary Examiner*—Scott Bushey
(74) *Attorney, Agent, or Firm*—Darby & Darby P.C.

(57) ABSTRACT

A UV disinfection humidifier has its disinfection properties improved by recirculating the water through the UV treatment unit and/or guiding the water along the UV tube in a helical path.

17 Claims, 4 Drawing Sheets

HUMIDIFIER WITH IMPROVED UV DISINFECTION

CROSS REFERENCE TO RELATED APPLICATIONS

This application is a nonprovisional application corresponding to U.S. provisional application Ser. No. 60/573,982 filed 24 May 2004 and Ser. No. 60/576,776 filed 2 Jun. 2004.

FIELD OF THE INVENTION

My present invention relates to a humidifier with improved UV disinfection of the water delivered to the air.

BACKGROUND OF THE INVENTION

It is known to provide disinfection in a humidifier by, for example, making parts thereof which come into contact with the water of a material which contains a biocide or by providing a disinfection source to which the water is exposed.

In a typical humidifier having a water reservoir which can be refilled by the user from a sink or the like, the water is passed to a dispersing unit which can be a mechanical humidifier, a wick through which air is passed or some other dispersing source like an ultrasonic atmosphere air distributor. The humidifier usually also includes a fan or the like for inducing flow of air through the humidifier and back into the room after that air has been moistened.

It has been found that a significant degree of disinfection can be accomplished by passing the water through a chamber which is exposed to UV (ultraviolet) radiation.

OBJECTS OF THE INVENTION

It is the principal object of the present invention to provide an improved humidifier in which the degree of sterilization of the water delivered to the water-dispersal element can be significantly enhanced.

Another object of the invention is to provide a humidifier which can ensure a greater degree of microbicidal treatment of the water than has heretofore been the case.

Still another object of the invention is to provide a humidifier of the in disinfection type whereby the level of microorganisms in the moisture dispersed into the air can be significantly reduced by comparison with earlier UV humidifiers.

It is a corollary object of the invention to provide an improved humidifier in which the measurable microorganism content of the water reaching the disbursing unit of the humidifier has a microorganism content significantly reduced beyond values which are attainable with present day humidifiers.

SUMMARY OF THE INVENTION

These objects are achieved, in accordance with the invention in a humidifier comprising:

a housing;

a water reservoir adapted to be mounted on the housing for supplying water to the humidifier;

a sterilizing path in the housing through which water can flow and in which water is exposed to ultraviolet radiation to reduce a level of microorganisms therein;

a moisture dispersal unit on the housing connected to the path and receiving water therefrom for dispersing moisture into air traversing the housing; and a pump in the housing connected to the sterilizing path for circulating water therethrough so that at least some water supplied to the moisture dispersal unit is exposed more than once to the ultraviolet radiation along the sterilization path.

An important feature of the invention, however, which can be used without that recirculation but which is useful together therewith to further increase the duration with which the water is subjected to the UV radiation is to cause the water to pass the UV source in a helical path.

Thus the humidifier according to the invention can comprise:

a housing;

a water reservoir adapted to be mounted on the housing for supplying water to the humidifier;

a sterilizing path in the housing through which water can flow and in which water is exposed to ultraviolet radiation to reduce a level of microorganisms therein, the sterilizing path being a helical path with a plurality of turns around an elongated ultraviolet lamp; and a moisture dispersal unit on the housing connected to the path and receiving water therefrom for dispersing moisture into air traversing the housing.

In a combined apparatus with both of these features, the humidifier can comprise the moisture dispersal unit which is a wick.

Thus I have found in a first aspect of the invention that, while humidifiers provided with active disinfection systems can reduce microorganism content to practically negligible levels, even in cases of resistant microorganisms and with microorganisms which can be successfully reduced to very low levels, the microorganism content in the air which is discharged into the room can be reduced still further. This is achieved, in accordance with the invention by collecting a portion of the water from the water dispersing means and recycling it back to the disinfection means. In particular, in the case of a wick which disperses only a small fraction of the water supplied thereto into the air in any unit of time, the water flowing from the wick is collected is recycled to the disinfection means which preferably is a chamber provided with a UV lamp.

Surprisingly, a relatively large proportion of the water which passes through the apparatus is thereby recycled through the UV lamp chamber at least several times and in each pass has its microorganism content further reduced.

The apparatus can be provided, if desired, with a HEPA filter for the air which is drawn through the apparatus and into which the water is dispersed to further displace the particular content of the humidifier air discharge by the apparatus.

In the second aspect of the invention, it has been found, quite surprisingly, that it is possible within a very limited space to provide a relatively long contact time between the UV source and the water by guiding the water in a helical path around and along the UV light source. Indeed, the degree of reduction in microorganisms in the water which reaches the dispersal unit of the humidifier in this manner is greatly increased. The reduction in microorganisms which may be dispersed into the room can be practically complete according to the invention if, in addition, there is recirculation of a part of the water to the sterilization.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
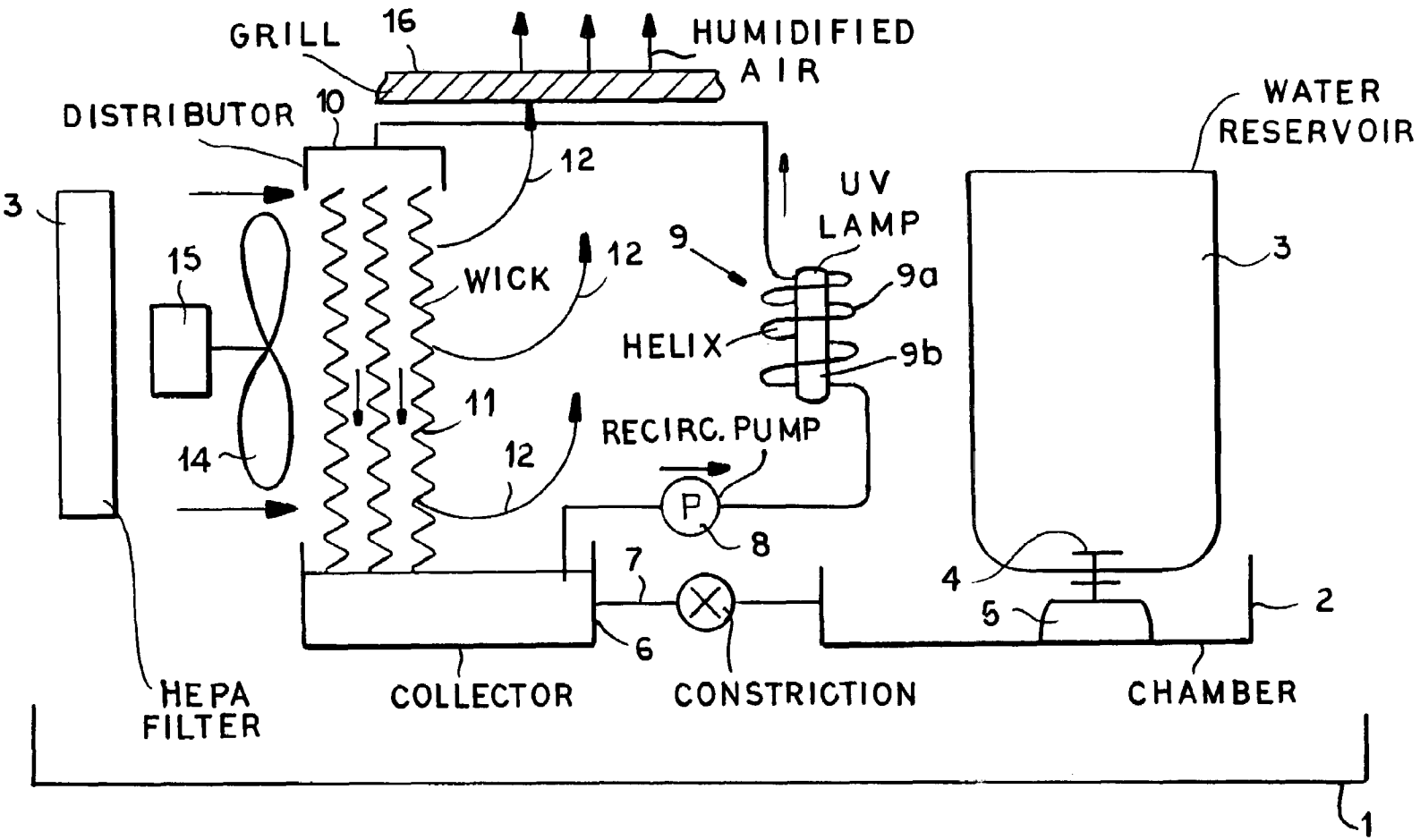
FIG. 1 is a diagram illustrating principles of the invention.

The humidifier shown in FIG. 1 in highly diagrammatic form comprises a housing 1 in which all of the other elements shown can be mounted. The housing can have a chamber 2 receiving tap water from an invertible water reservoir 3 having a self-closing valve 4 which is open when that water reservoir is inverted on a pedestal 5 of the chamber 2. From the chamber 2 the water flows, as required by the level of water in a collector 6 through a restricted passage 7 into the collector from which the water may be drawn by a recirculating pump 8 and fed through a path in which it is subjected to a disinfection treatment by ultraviolet rays before it is supplied to a distributor 10. The UV treatment unit represented at 9 can include a helical path 9*a* for the water surrounding an elongated UV lamp 9*b* and designed (see FIG. 4) such that a wall of the helical path is formed by the quartz envelope of the lamp tube so that the water is subjected to an intense UV disinfection over its extended path along the tube.

The UV disinfected water is spread by the distributor over the wick structure 11 which is permeable to air so that some of the water passes along capillaries in the wick and some can flow along the surfaces of the wick to be picked up by air 12 flowing through the wick. Excess water cascades into the collector 6 from which it is recirculated by the pump 8 to the UV treatment at 9. The air which can be drawn into the unit through HEPA filter 13 by a fan 14 is driven by motor 15, is forced through the wick and is thereby humidified before it is discharged into the room through a grill 16.

Figure 2:
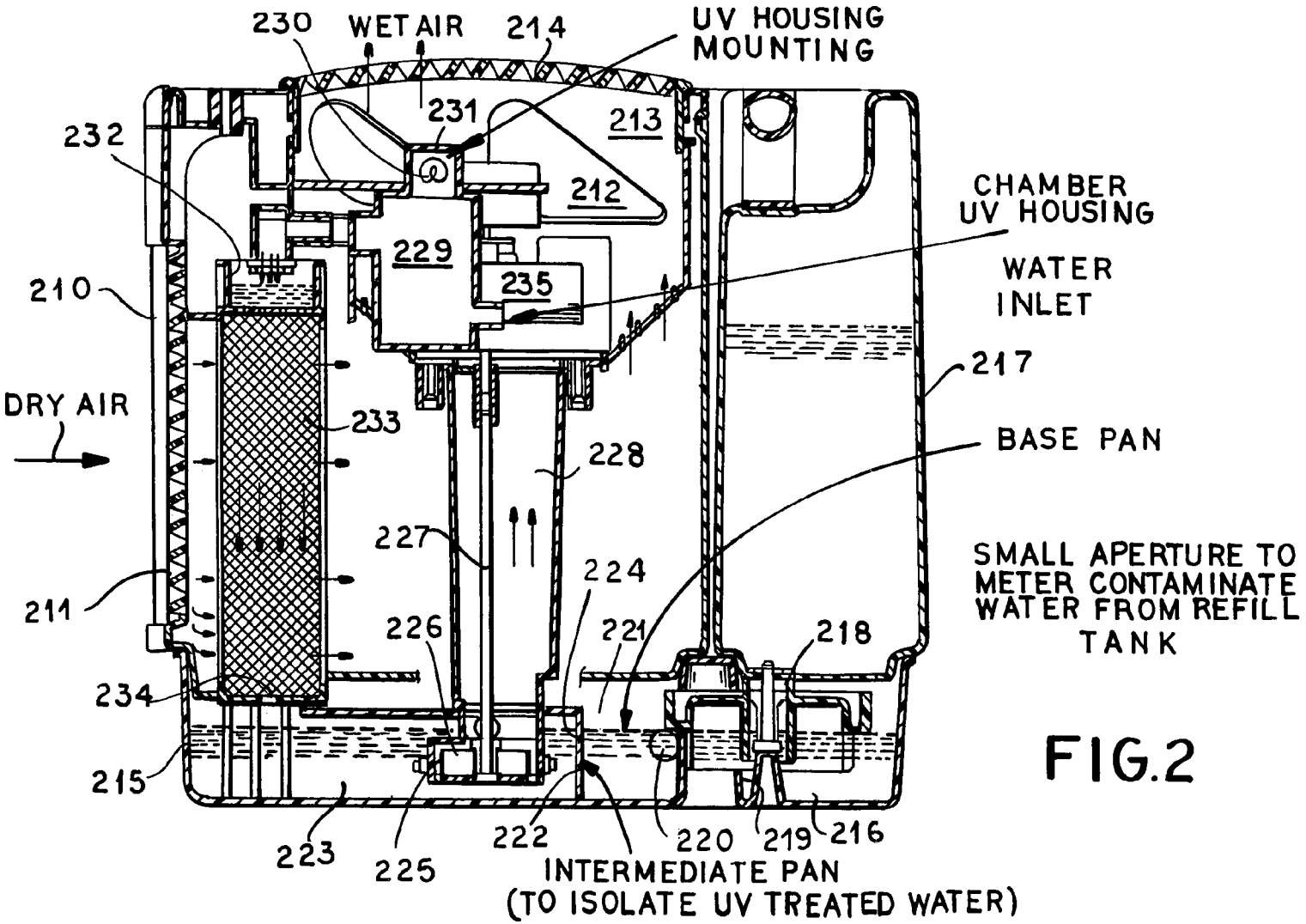
FIG. 2 is a cross sectional view through a humidifier which can be of the type described, for example, in U.S. Pat. No. 5,783,117 and which, however, is equipped with the improvement of the present invention.
Figure 3:
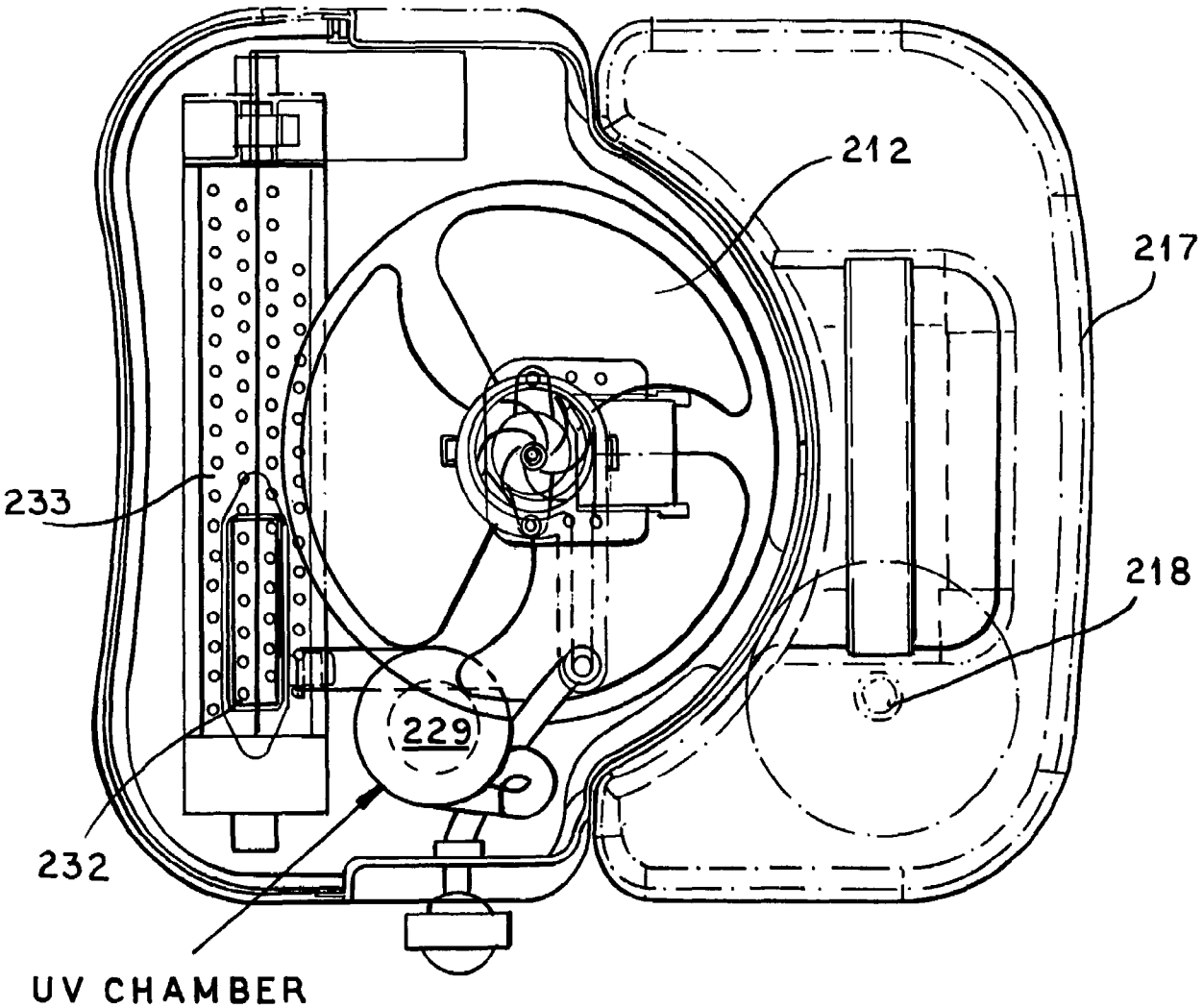
FIG. 3 is a plan view of this apparatus with the air discharger grill or cover removed.

Basically the apparatus of FIGS. 2 and 3 comprises a housing 210 with a grill 211 through which dry room air is drawn by a controlling blower blade 212 in a discharge plenum 213 having an outlet grill 214 through which the humidified air is discharged. The base 215 of the humidifier has an inlet reservoir 216 which communicates with a refill tank 217 the valve 218 at the bottom of the tank. The tank may be removed from the apparatus, brought to a sink filled and returned to the apparatus so that the valve 218 is opened by engagement with a pedestal 219 when the tank is replaced by a small aperture 220 and the reservoir 216 permits water to flow at a metered rate into a base pan 221 which is separated by a wall 222 from an intermediate pan 223. Water is allowed to flow from the base pan 221 into the intermediate pan 223 through another metering aperture 224.

A pump 225 whose impeller 226 is driven by a shaft 227, displaces the water from the intermediate pan 223 upwardly through a pipe 228 to a sterilization chamber 229 exposed to UV from a lamp 230 mounted in a lamp housing 231. The sterile water passes to a distributor 232 which distributes the water over a wick 233 which is traversed by the dry air admitted through the grill 211.

A small portion of the water in the wick is dispersed in the air which passes into the plenum 213 and is fed to the room by the blower 212. The remainder of the water drains downwardly and is discharged from the wick through an outlet 234 into intermediate pan 223 and is thereby recirculated by the pump 225 to the circulation chamber 229.

The blade 212 is driven by a motor 235 which is connected to the shaft 227 and likewise drives the pump 226.

In FIG. 3 it is clear that the sterilization chamber 229 is offset from the blade 212 and thus does not interfere with it.

The apparatus can otherwise be similar to that of U.S. Pat. No. 5,783,117 and reference may be had to that patent for any of the parts of the apparatus which have not been described herein or may not be relevant to the improvement of the invention.

Figure 4:
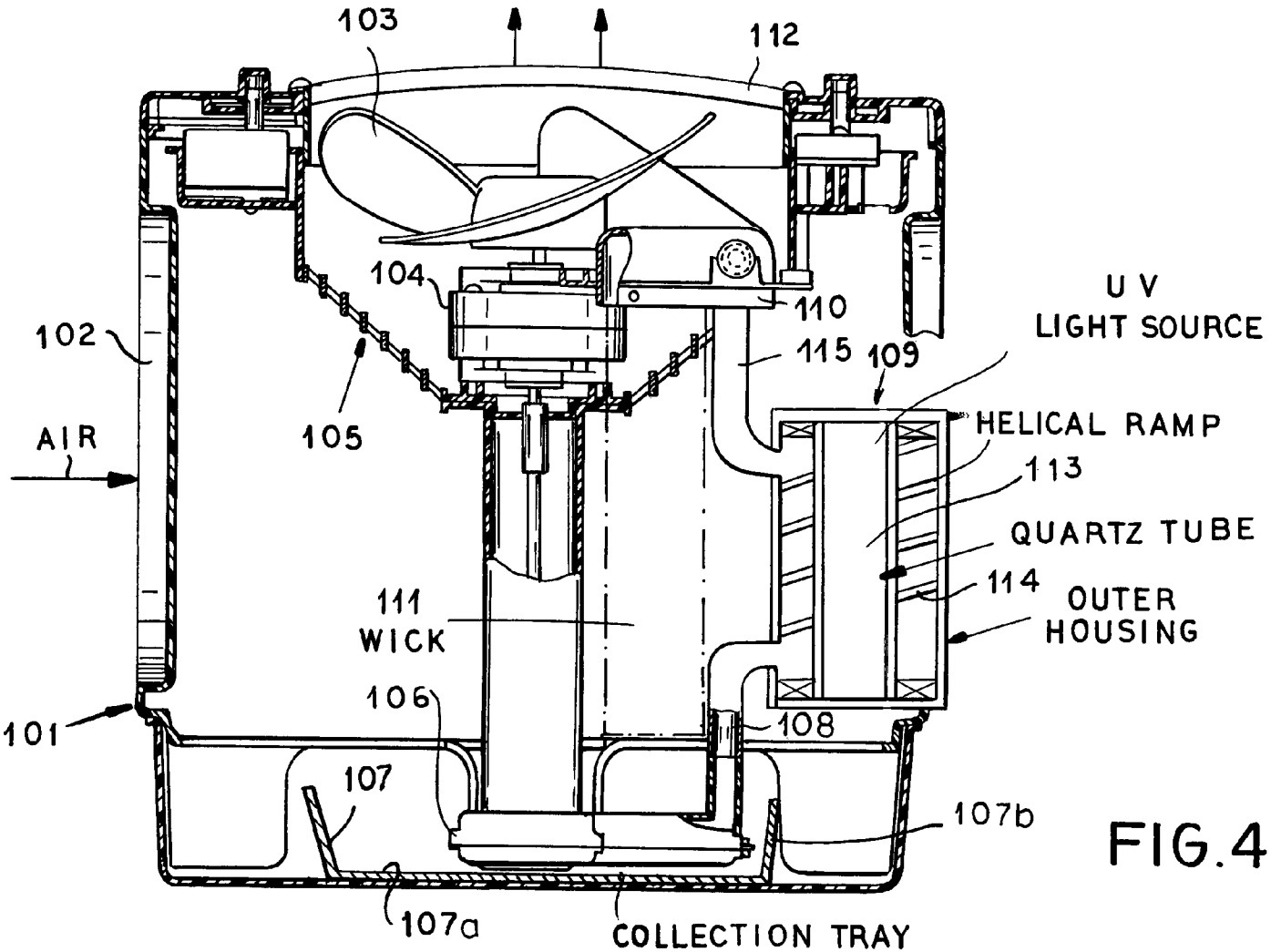
FIG. 4 is a diagram of another humidifier generally of the type shown in the aforementioned patent but with the helical path configuration of the UV treatment unit.

In FIG. 4 of the drawing I have shown a housing 101 having a grill 102 through which air can be induced to flow into the housing by a fan 103 driven by an electric motor 104 and located above the baffle system 105 through which the air is induced to flow upwardly. The motor 104 also drives a pump 106 which is located in a tray 107 into which water is metered from a water reservoir (not shown) which may be mounted on the housing 101. The tray 107 can include an intermediate pan 107*a* isolating the sterile water and into which water is admitted from the tray 107 through an aperture 107*b*. The water from the reservoir 107 is drawn upwardly through a pipe 108 and a disinfection unit 109 into a distributing chamber 110 from which it is permitted to cascade through a wick 111. The excess water returns to the pan 107*a*.

In operation, therefore, some of the air drawn into and through the grill 102 passes through the wick and along the wick 111, is humidified and flows upwardly through the baffles 105 to be discharged from the humidifier through a grill 112. The water is disinfected by ultraviolet light from a quartz tube 113 and the water passes upwardly along a helical ramp 114, i.e. in a helical path along and around the tube 113. From the disinfection unit 109, the water flows at 115 to the distributor.

The sterilized water which is not dispersed into the atmosphere in the air flow through the humidifier, returns to the tray 107 from which it is pumped again into the disinfection unit and again exposed to UV.

I claim:

1. A humidifier comprising:

a housing;

a water reservoir adapted to be mounted on said housing for supplying water to said humidifier;

a source of ultraviolet radiation having at least one outer surface;

an enclosed helical sterilizing path in said housing through which water from the water reservoir flows, the enclosed path formed by a portion of the at least one outer surface of the source of ultraviolet radiation and an open faced helical conduit which is placed against the outer surface of the source of ultraviolet radiation such that the outer surface substantially seals the open face of the helical conduit to create the enclosed helical sterilizing path, such that water flowing through the sterilizing path flows around the source of ultraviolet radiation and is bounded by the portion of the at least one outer surface of the source of ultraviolet radiation and is exposed to ultraviolet radiation at least once to reduce a level of microorganisms therein;

a moisture dispersal unit on said housing connected to said path and receiving water therefrom for dispersing moisture into air traversing said housing, all water being dispersed by said moisture dispersal unit having flowed through the sterilizing path and having been exposed to ultraviolet radiation therein prior to dispersal; and a pump in said housing connected to said sterilizing path for circulating water therethrough so that at least some water supplied to said moisture dispersal unit is exposed more than once to the ultraviolet radiation along said sterilization path.

2. The humidifier of claim 1, further comprising a collector in said housing below said moisture dispersal unit for receiving excess water therefrom, said pump having an intake connected to said collector.

3. The humidifier of claim 2 wherein said moisture dispersal unit comprises an air permeable structure having surfaces along which water can flow.

4. The humidifier of claim 3, further comprising a fan in said housing for inducing air flow through said structure.

5. The humidifier of claim 4 wherein said structure comprises a wick at least partly inducing water flow therein by capillarity.

6. The humidifier of claim 3 wherein said structure comprises a water distributor connected to said path at a top of the structure and from which water flows down along surfaces of said structure.

7. The humidifier of claim 3 wherein said housing is formed with a chamber receiving water from said reservoir and a constricted passage connecting said chamber with said collector to admit fresh water from said reservoir into said collector.

8. The humidifier of claim 1 wherein said path comprises a chamber exposed to light emitted by an ultraviolet lamp on said housing.

9. The humidifier of claim 1 wherein said path comprises a helical path surrounding an elongated ultraviolet lamp and having a plurality of turns.

10. A humidifier comprising:

a housing;

a water reservoir adapted to be mounted on said housing for supplying water to said humidifier;

a source of ultraviolet radiation, the source of ultraviolet radiation being elongated and having at least one outer surface;

an enclosed sterilizing path in said housing through which water from the water reservoir flows, the sterilizing path being substantially helical and having a plurality of turns around the source of ultraviolet radiation, the enclosed path formed by a portion of the at least one outer surface of the source of ultraviolet radiation and an open faced helical conduit which is placed against the outer surface of the source of ultraviolet radiation such that the outer surface substantially seals the open face of the helical conduit to create the enclosed sterilizing path, such that water flowing through the sterilizing path is bounded by the portion of the at least one outer surface of the source of ultraviolet radiation and is exposed to ultraviolet radiation at least once to reduce a level of microorganisms therein; and a moisture dispersal unit on said housing connected to said path and receiving water therefrom for dispersing moisture into air traversing said housing, all water being dispersed by said moisture dispersal unit having flowed through the sterilizing path and having been exposed to ultraviolet radiation therein;

a pump in said housing connected to said sterilizing path for circulating water therethrough so that at least some water supplied to said moisture dispersal unit is exposed more than once to the ultraviolet radiation along said sterilization path;

a collector in said housing below said moisture dispersal unit for receiving excess water therefrom, said pump having an intake connected to said collector, said moisture dispersal unit being an air permeable structure having surfaces along which water can flow;

a fan in said housing for inducing air flow through said structure; and a water distributor connected to said path and located at a top of the structure and from which water flows down along surfaces of said structure.

11. A humidifier comprising:

a housing;

a water reservoir adapted to be mounted on said housing for supplying water to said humidifier;

a source of ultraviolet radiation, the source of ultraviolet radiation being elongated and having at least one outer surface;

an enclosed sterilizing path in said housing through which water from the water reservoir flows, the sterilizing path being substantially helical and having a plurality of turns around the source of ultraviolet radiation, the enclosed path formed by a portion of the at least one outer surface of the source of ultraviolet radiation and an open faced helical conduit which is placed against the outer surface of the source of ultraviolet radiation such that the outer surface substantially seals the open face of the helical conduit to create the enclosed sterilizing path, such that water flowing through the sterilizing path is bounded by the portion of the at least one outer surface of the source of ultraviolet radiation and is exposed to ultraviolet radiation at least once prior to dispersal to reduce a level of microorganisms therein;

a moisture dispersal unit on said housing connected to said sterilizing path and receiving water therefrom for dispersing moisture into air traversing said housing, all water being dispersed by said moisture dispersal unit having flowed through the sterilizing path and having been exposed to ultraviolet radiation therein; and a collector for collecting excess water from said dispersal unit and recirculating water from said collector to said ultraviolet sterilizer.

12. The humidifier of claim 11 wherein said moisture dispersal unit comprises a wick.

13. The humidifier of claim 11 wherein said moisture dispersal unit comprises an air-permeable structure having surfaces along which water flows and supplied from said sterilizing path with water through a distributor on top of said structure.

14. The humidifier of claim 13, further comprising a fan in said housing for inducing a flow of air through said air-permeable structure.

15. A humidifier comprising:

a housing having an air inlet, an air outlet and an air path for air through said housing;

a water dispersal unit along said air path for dispersing water into said air to humidify the air delivered to said air outlet;

an ultraviolet sterilizer for said water upstream of said water dispersal unit such that all water being dispersed by said water dispersal unit is exposed to ultraviolet radiation from said ultraviolet sterilizer prior to dispersal, said ultraviolet sterilizer having at least one sterilizing surface;

an enclosed helical water path formed by the at least one sterilizing surface and an open faced helical conduit which is placed against the at least one sterilizer surface such that the at least one sterilizer surface substantially seals the open face of the helical conduit to create the enclosed helical water path, such that water flowing through the helical water path is bounded by the portion of the at least one outer surface of the ultraviolet sterilizer and is exposed to ultraviolet light at least once to reduce a level of microorganisms therein;

a collector for collecting excess water from said dispersal unit and recirculating water from said collector to said ultraviolet sterilizer; and an air cleaner along said air path.

16. The humidifier of claim 15 wherein said air cleaner comprises a HEPA filter.

17. The humidifier defined in claim 15 wherein said water dispersal unit comprises a wick.

* * * * *